US005588479A

United States Patent [19]

Leadbeatter et al.

[11] Patent Number: 5,588,479

[45] Date of Patent: Dec. 31, 1996

[54] STRIP CASTING

[75] Inventors: Darren J. Leadbeatter, Dapto, Australia; Heiji Kato, Yokosuka; Hisahiko Fukase, Tokyo, both of Japan

[73] Assignees: Ishikawajima-Harima Heavy Industries Company Limited, Tokyo, Japan; BHP Steel (JLA) Pty Ltd., Melbourne, Australia

[21] Appl. No.: 547,657

[22] Filed: Oct. 24, 1995

[30] Foreign Application Priority Data

Jan. 12, 1995 [AU] Australia ..... PN0512

[51] Int. Cl.[6] ..... B22D 11/06

[52] U.S. Cl. ..... 164/480; 164/428

[58] Field of Search ..... 164/428, 480

[56] References Cited

U.S. PATENT DOCUMENTS 5,178,205 1/1993 Fukase et al. ..... 164/480

5,184,668 2/1993 Fukase et al. ..... 164/480

*Primary Examiner*—Kuang Y. Lin

*Attorney, Agent, or Firm*—Nikaido, Marmelstein, Murray & Oram LLP

[57] ABSTRACT

A molten metal casting pool is confined between a pair of casting rolls (12) by side closure plates (18) applied to the ends of the rolls (12) by thrusters (21). Side closure plates (18) are mounted in holders (25) which are pivotally connected to thrusters (21) by pivot pins (26) so that the side plates (18) can tilt about the pivot connections. Pivot pins (26) are located at such height above the nip between rolls (12) that effect of outward pressure on plates (18) by molten metal of the casting pool is such as to rotationally bias the plates (18) about the pivots in such directions that their bottom ends are biased inwardly to produce increased scaling pressure at bottom of casting pool.

4 Claims, 6 Drawing Sheets

STRIP CASTING

TECHNICAL FIELD

This invention relates to continuous casting of metal strip in a twin roll caster. It has particular, but not exclusive, application to the casting of steel strip.

In a twin roll caster molten metal is introduced between a pair of contra-rotated horizontal casting rolls which are cooled so that metal shells solidify on the moving roll surfaces and are brought together at the nip between them to produce a solidified strip product delivered downwardly from the nip between the rolls. The term "nip" is used herein to refer to the general region at which the rolls are closest together. The molten metal may be poured from a ladle into a smaller vessel from which it flows through a metal delivery nozzle located above the nip so as to direct it into the nip between the rolls, so forming a casting pool of molten metal supported on the casting surfaces of the rolls immediately above the nip and extending along the length of the nip. This casting pool is confined between side plates or dams held in sliding engagement with end surfaces of the rolls so as to dam the two ends of the casting pool against outflow.

It is very important to maintain good sealing engagement between the side plates and the end surfaces of the rolls since leakage can lead to the formation of severe defects at the edges of the cast strip product and the solidifying leaked metal can cause rapid destruction of the wear surfaces of the side plates and complete loss of sealing. This problem is exacerbated by deformation of the roll ends due to thermal expansion during casting. Parts of the roll passing through the pool during each rotation are heated progressively as they move from the upper regions of the pool to the nip. Consequently there is a tendency for the mid-parts of the roll in the region of the nip to expand outwardly more than the upper parts of the roll which deforms the roll end surface during casting. This can lead to excessive wear of the side plates adjacent the nip. By the present invention the side plates can be mounted and applied to the roll ends in such a way as to alleviate these problems.

DISCLOSURE OF THE INVENTION

According to the invention there is provided a method of casting metal strip comprising:

supporting a casting pool of molten metal on a pair of chilled casting rolls forming a nip between them;

confining the casting pool by applying a pair of side closure structures to end surfaces of the rolls at the ends of the nip; and rotating the chilled rolls in mutually opposite directions to produce a solidified strip product passing downwardly from the nip;

wherein the side closure structures are applied to said end surfaces of the rolls by a pair of generally horizontally acting thrusters connected one to each of the closure structures by pivot connections allowing tilting movements of the closure structures, the thrusters apply opposing inward forces to the side closure structures at said pivot connections, and each of the pivot connections is disposed at or below the centre of effort of the outward forces applied to the respective side closure structure by the molten metal of the pool.

Preferably, each pivot connection is disposed below said centre of effort whereby the respective side closure structure is rotationally biased by the outward pressure applied to it by the molten metal of the pool in such a direction that its lower part is biased inwardly of the rolls.

Preferably further, the pivot connection is disposed below said centre of effort by a distance of at least 0.5 cm and more preferably by a distance of the order of 1 cm.

The invention further provides apparatus for casting metal strip comprising a pair of generally horizontal casting rolls forming a nip between them;

metal delivery means to deliver molten metal into the nip between the casting rolls to form a casting pool of molten metal supported on the rolls;

a pair of side closure structures to engage end surfaces of the rolls whereby to form side confining closures for the casting pool;

means to chill the casting rolls; and means to rotate the casting rolls in mutually opposite directions whereby to produce a cast strip delivered downwardly from the nip;

wherein the apparatus comprises side closure applicator means comprising a pair of generally horizontally acting thrusters connected one to each of the side closure structures by pivot connections allowing tilting movements of the side closure structures, the thrusters are disposed to apply opposing inward closure forces to the side closure structures at said pivot connections, and each of the pivot connections is disposed at such a level above the nip that in use of the apparatus it will be disposed at or below the centre of effort of the outward forces applied to the respective side plate by the molten metal of the pool.

The side closure structures may comprise a pair of plates to engage said end surfaces of the rolls and a pair of plate holders which hold the plates and are pivotally connected to the thrusters by said pivot connections.

The thrusters may comprise a pair of hydraulic or pneumatic cylinder units.

BRIEF DESCRIPTION OF THE DRAWINGS

In order that the invention may be more fully explained one particular embodiment will be described in detail with reference to the accompanying drawings in which.

BEST MODE OF CARRYING OUT THE INVENTION

Figure 1:
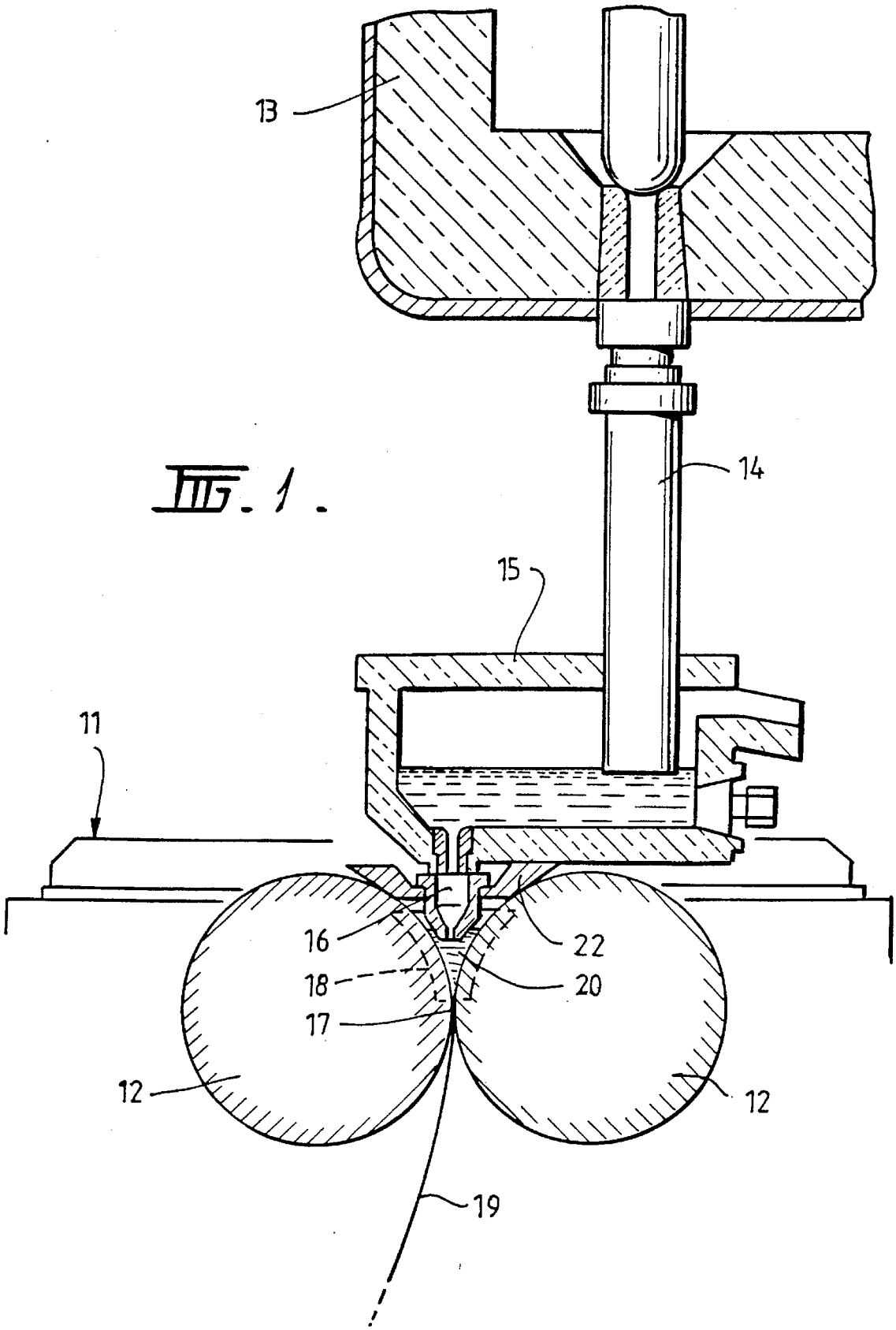
FIG. 1 is a vertical cross-section through a twin roll caster.
Figure 2:
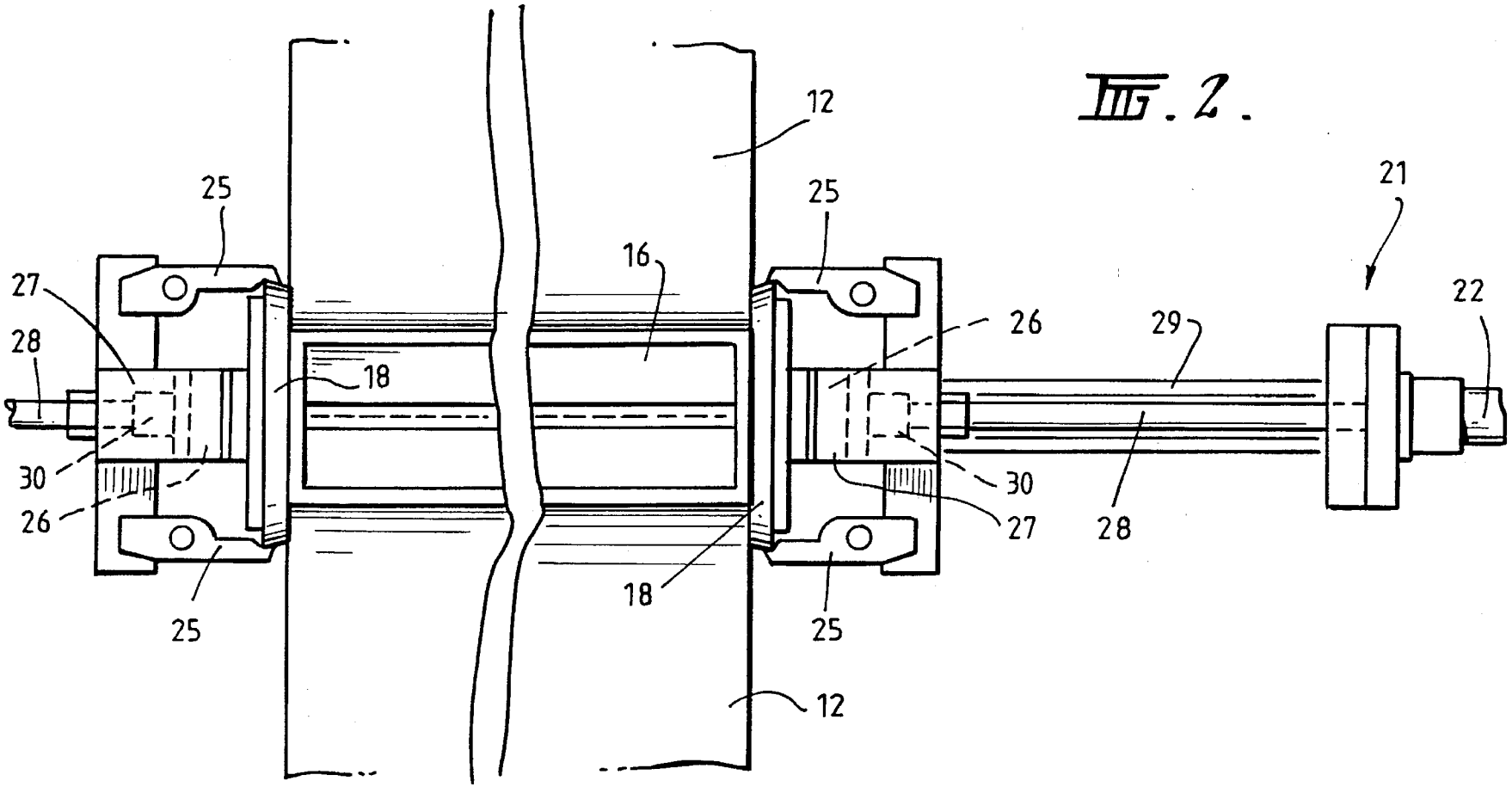
FIG. 2 is a plan view of the twin roll caster illustrated in FIG. 1.

The illustrated twin roll caster comprises a main machine frame 11 which supports a pair of parallel casting rolls 12. Molten metal is supplied during a casting operation from a ladle 13 through a refractory ladle outlet shroud 14 to a tundish 15 and thence through a metal delivery nozzle 16 into the nip 17 between the casting rolls 12. Hot metal thus delivered to the nip 17 forms a pool 20 above the nip and this pool is confined at the end of the rolls by a pair of side closure plates 18 which are applied to stepped ends of the rolls by a pair of thrusters 21 comprising hydraulic cylinder units 22. The upper surface of pool 20 (generally referred to as the "meniscus" level) may rise above the lower end of the delivery nozzle so that the lower end of the delivery nozzle is immersed within this pool.

Casting rolls 12 are water cooled so that shells solidify on the moving roller surfaces and are brought together at the nip 17 between them to produce a solidified strip product 19 at the roll outlet. This product may be fed to a standard coiler (not shown).

The illustrated twin roll caster as thus far described is of the kind which is illustrated and described in some detail in granted Australian Patents 631728 and 637548 and U.S. Pat. Nos. 5,184,668 and 5,277,243 and reference may be made to those patents for appropriate constructional details which form no part of the present invention.

In accordance with the present invention the side plates 18 are mounted in holders 25 which are pivotally connected to the thrusters 21 so that the side plates can tilt about the pivot connections and the thrusters apply opposing forces through the pivots.

Figure 3:
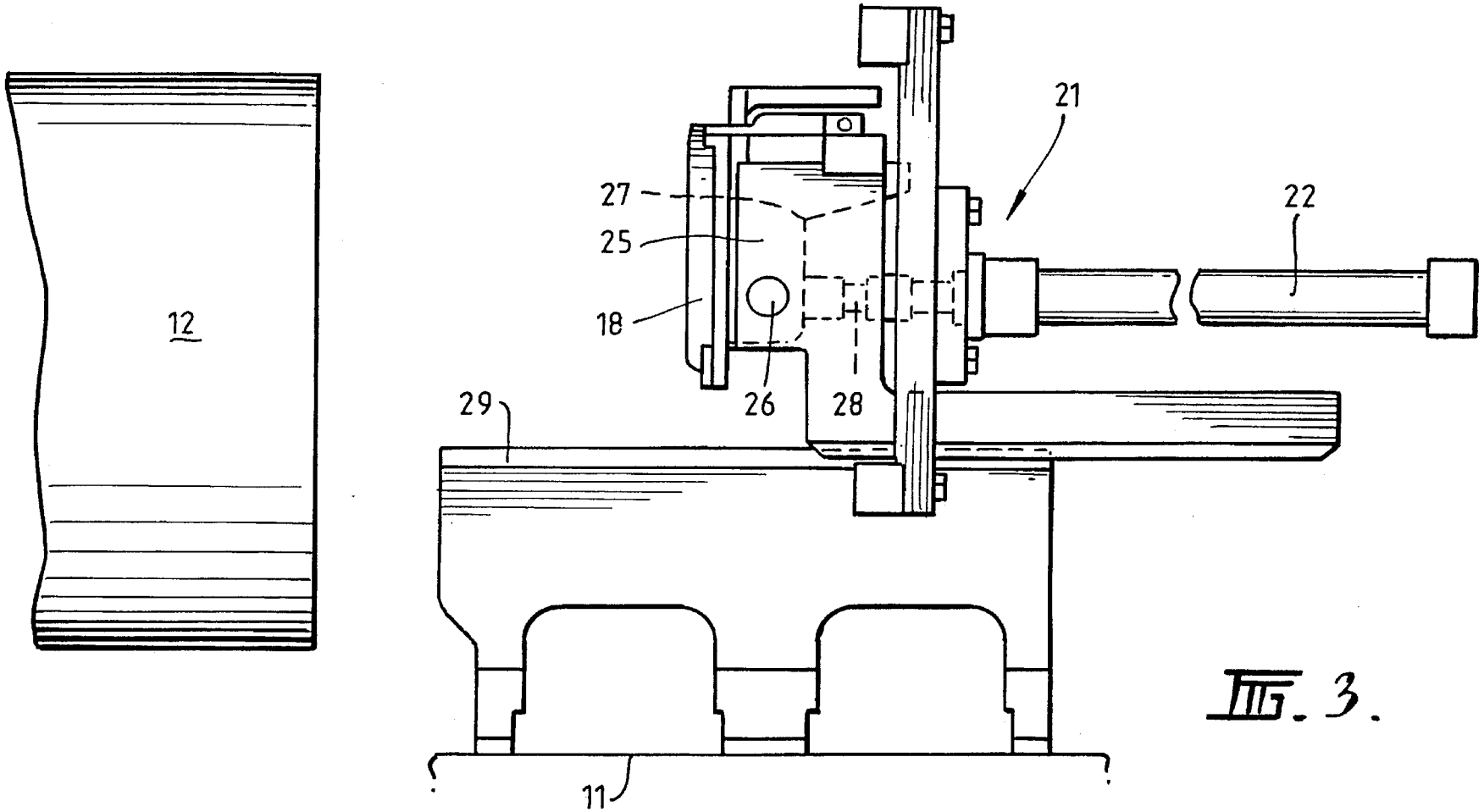
FIG. 3 illustrates one of a pair of side plate applicators incorporated in the apparatus and shows the applicator in a retracted position.
Figure 4:
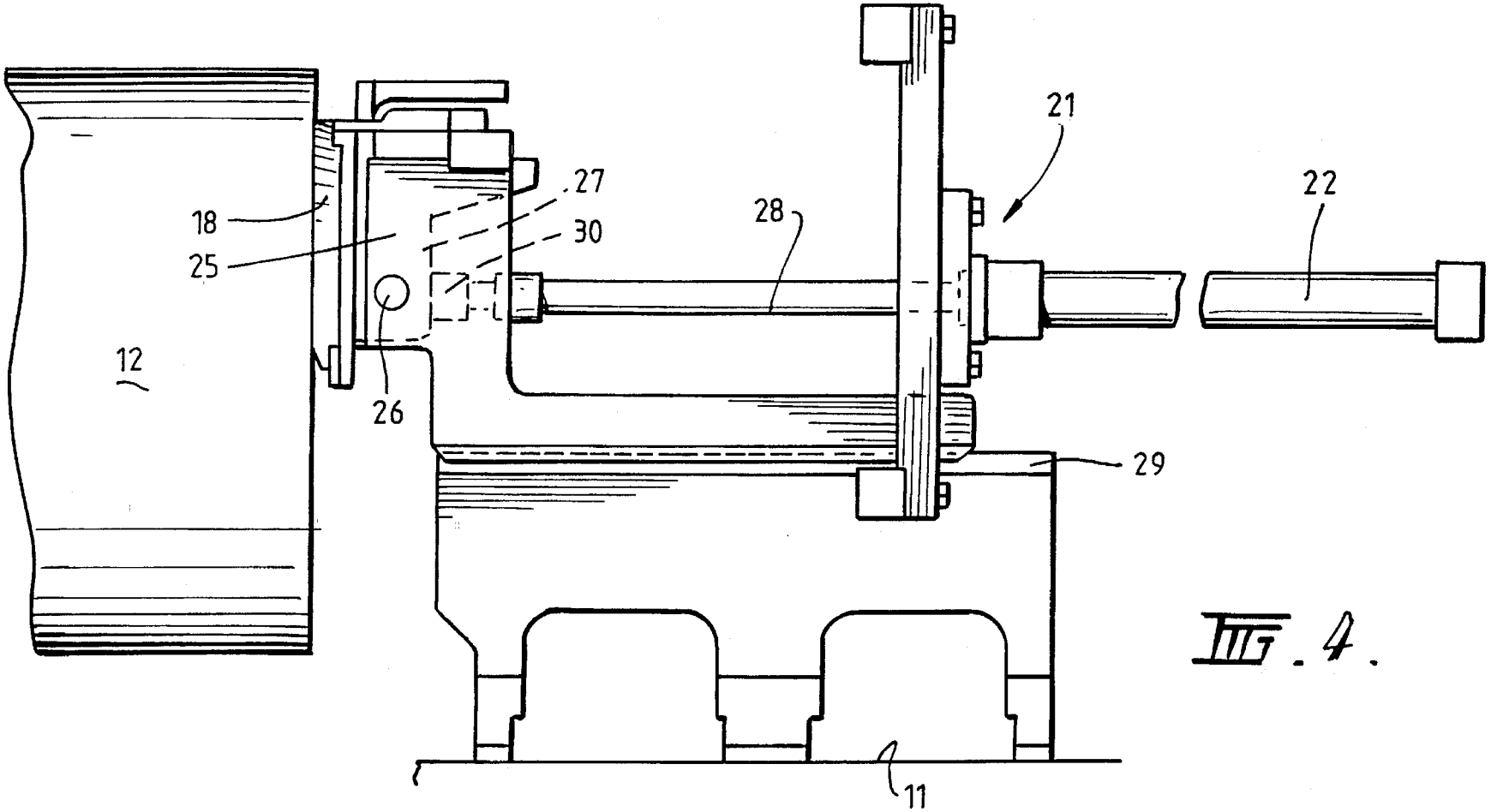
FIG. 4 shows the side plate applicator in an extended position.

As most clearly seen in FIGS. 3 and 4 each side plate 18 is mounted in a side plate holder 25 which is pivotally connected by a pivot pin 26 to a thruster body 27 which is connected at 30 to the piston rod 28 of the respective hydraulic cylinder unit 22. Accordingly each side plate 18 and its associated holder 25 constitutes a side closure structure which can pivot about the respective pin 26. Each thruster 21 comprises one of the hydraulic cylinder units 22 and the respective thruster body 27. The thruster bodies 27 are constrained to run on tracks 29 so as to move horizontally on extension and retraction of the cylinder units. With this arrangement inward closure forces applied by the cylinder units are effectively applied to the side plate holders through the pivots and the side plates can pivot together with the side plate holders about the pivots so as to permit forward and rearward tilting of the side plates about the axes of the pivot pins. The pivot pins are located at such a height above the level of the nip between the casting rolls that the effect of the outward pressure on the side plates due to the molten metal in the casting pool is such as to rotationally bias the side plates about the pivots in such directions that their bottom ends are biased inwardly so as to produce increased sealing pressure at the bottom of the casting pool. The arrangement also permits tilting of the side plates so as to accommodate deformation of the casting roll end surfaces due to thermal expansion during casting and at the same time maintains a biasing action which increases the sealing forces at the bottom of the pool so as to counter-act the increased ferrostatic pressure at the bottom of the pool where there is accordingly the greatest tendency for leakage.

Appropriate positioning of the pivots will depend on the diameter of the casting rolls, the height of the casting pool and thickness of the strip being cast. The manner in which correct positioning of the pivots can be determined will be described with reference to FIGS. 5 to 7.

Figure 5:
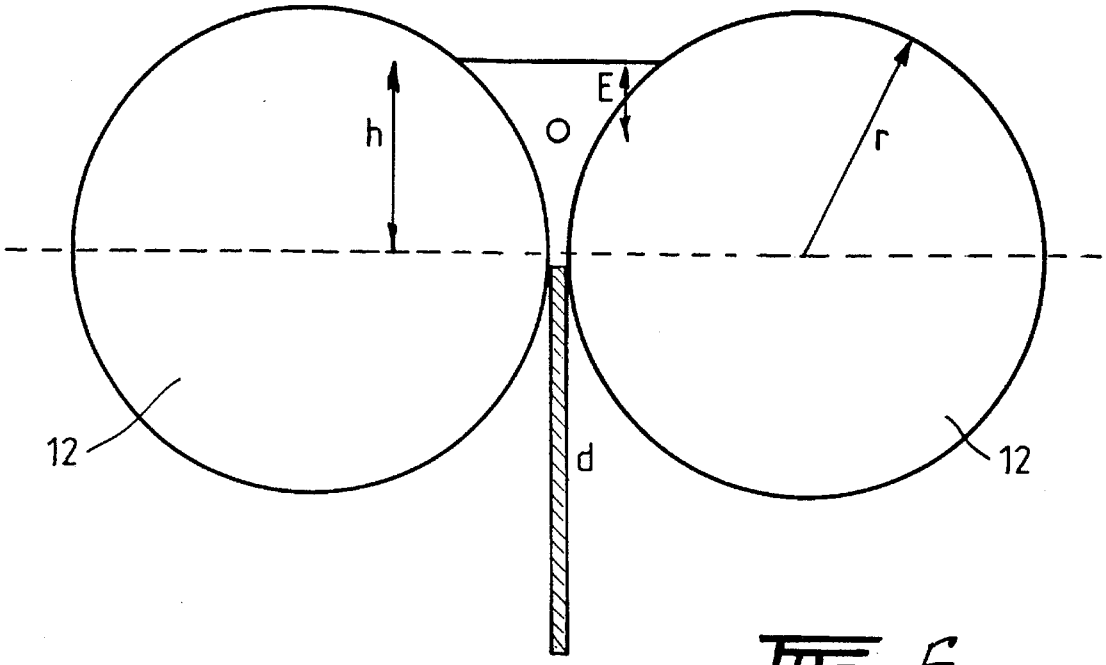
FIGS. 5 and 6 diagrammatically illustrate the critical parameters to be taken into account in order to determine correct positioning of the applicator pivots.
Figure 6:
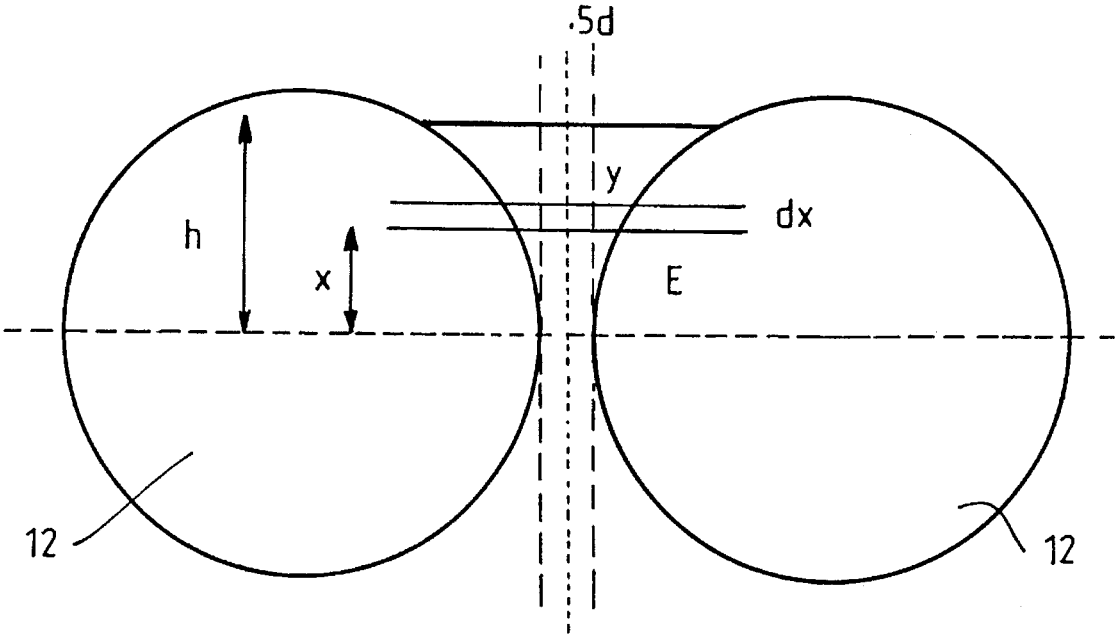
Figure 7:
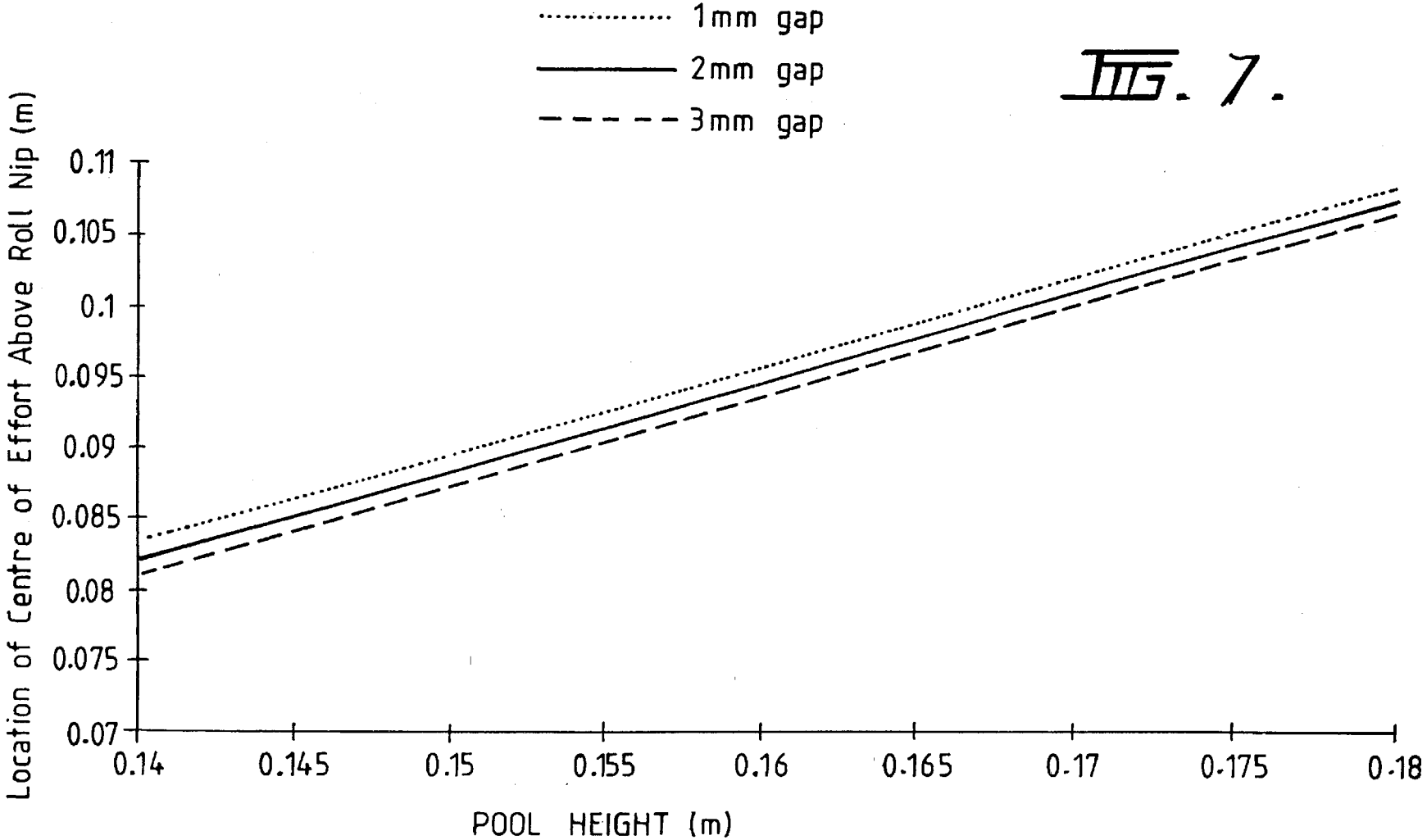
FIG. 7 is a graph which plots the position of the centre of effort of pool pressure on the side plates for varying strip thickness and pool heights.

FIGS. 5 and 6 show the critical parameters to be taken into account in order to determine correct positioning of the pivots. Consider the static pressure applied by liquid steel on a side dam as illustrated in FIG. 5. It should be noted that the actual shape of the side plate is unimportant as the force applied by the steel is applied over a region defined by the two rolls, the height of the pool and the gap between the rolls. Below the nip the steel can be assumed to be solid.

The force provided by the static pressure of the liquid steel on the side plate can be assumed to be concentrated at a point E, the centre of effort. The horizontal location of the centre of effort can be assumed to lie on the axis of symmetry of the pool. The vertical location of this centre of effort can be found by considering moments about the unknown location, E (see FIG. 6). The ferrostatic pressure at this location, x, is given by ρgx, and the force on the element is given by ρgx (y+d/2) dx. The rotational moment of this element about the unknown location E is given by (ρgx) (y+d/2) dx (x−E). The definition of the centre of effort is the location at which all moments sum to zero:

$$\int_0^h (\rho g x)(x-E)(y+d/2)\,dx = 0$$

or, $$\rho g \int_0^h x^2(y+d/2)\,dx - \rho g E \int_0^h x(y+d/2)\,dx = 0$$

where:

$$y = r - [r^2 - (x-h)^2]^{1/2}$$

Therefore, the centre of effort can be found from:

$$E = \frac{\int_0^h x^2(r - [r^2-(x-h)^2]^{1/2} + d/2)\,dx}{\int_0^h x\,(r - [r^2-(x-h)^2]^{1/2} + d/2)\,dx}$$

Evaluation of these integrals leads to the following expression:

$$E = \frac{A-B}{C-D}$$

Where:

$$A = \frac{(d+2r)\,h^3}{6} + 3/4 r^3 h$$

$$B = [r^2-h^2]^{1/2}\left(\frac{2h^3+13r^2h}{24}\right) + 1/8 r^2(4h^2+r^2)\mathrm{Arcsin}(h/r)$$

$$C = \frac{(d+2r)h^2}{4} + \frac{r^3}{3}$$

$$D = [r^2-h^2]^{1/2}\left(\frac{h^2+2r^2}{6}\right) + 1/2 r^2 h\mathrm{Arcsin}(h/r)$$

The location of the centre of effort above the roll nip is then given by h−E. This function has been plotted in FIG. 7, for varying strip thickness and pool heights.

Applying the side plate force through a pivot, at a vertical location slightly below this centre of effort, will cause the side plate below the pivot to be more forcefully applied to the rolls. In this case, the outward steel ferrostatic pressure works through the pivot to force the lower part of the side plate inwards, providing an improved seal. If the pivot is (through pool movement or bad judgement) placed above the centre of effort, then leaks are much more probable.

The optimum pivot location is slightly below the centre of effort. More particularly it is preferred that the pivot location be spaced below the level of the centre of effect by distance in the range 0.5 to 3 cm. More particularly, it is preferred that the spacing be of the order of 1 cm.

The illustrated construction has been advanced by way of example only and it could be modified considerably. For example, although it is preferred to locate the pivots a little below the level of centre of effort of the outward pressure on the side plates, it would be possible to have the pivots located generally at the same level as the centre of effort so as to obtain the benefit of relatively free tilting movement of the side plates to accommodate deformation of the roll ends on thermal expansion without the enhanced sealing at the lower part of the pool. The particular manner in which the side plates are pivotally connected to the thrusters could also be varied. Moreover, because the thruster bodies 27 are constrained to run on tracks 29 to move horizontally the manner in which the hydraulic cylinder units are connected to these bodies is not critical and may be varied. Specifically, it is not essential to align the cylinder units with the pivots and they could be positioned below or above the level of the pivots. It is accordingly to be understood that the invention is in no way limited to the details of the illustrated construction and that many modifications and variations will fall within its spirit and scope which extends to every novel feature and combination of features herein disclosed.

We claim:

1. A method of casting metal strip comprising:

supporting a casting pool of molten metal on a pair of chilled casting rolls forming a nip between them;

confining the casting pool by applying a pair of side closure structures to end surfaces of the rolls at the ends of the nip; and rotating the chilled rolls in mutually opposite directions to produce a solidified strip product passing downwardly from the nip;

wherein the side closure structures are applied to said end surfaces of the rolls by a pair of generally horizontally acting thrusters connected one to each of the closure structures by pivot connections allowing tilting movements of the closure structures, the thrusters apply opposing inward forces to the side closure structures at said pivot connections, and each of the pivot connections is disposed at or below the centre of effort of the outward forces applied to the respective side closure structure by the molten metal of the pool.

2. A method as claimed in claim 1, wherein each pivot connection is disposed below said centre of effort whereby the respective side closure structure is rotationally biased by the outward pressure applied to it by the molten metal of the pool in such a direction that its lower part is biased inwardly of the rolls.

3. A method as claimed in claim 2, wherein the pivot connection is disposed below said centre of effort by a distance of at least 0.5 cm.

4. A method as claimed in claim 3, wherein the pivot connection is disposed below said centre of effort by a distance of about 1 cm.

* * * * *